US007059162B1

(12) United States Patent
Tarpill et al.

(10) Patent No.: US 7,059,162 B1
(45) Date of Patent: Jun. 13, 2006

(54) DUAL FLARING TOOL

(75) Inventors: Andrew J. Tarpill, East Haddam, CT (US); Orelvis Migenes, Plainville, CT (US); Tadeusz Zagula, Hartford, CT (US)

(73) Assignee: Capewell Components, LLC, Cromwell, CT (US)

( * ) Notice: Subject to any disclaimer, the term of this patent is extended or adjusted under 35 U.S.C. 154(b) by 20 days.

(21) Appl. No.: 10/912,378

(22) Filed: Aug. 5, 2004

(51) Int. Cl.
*B21D 1/02* (2006.01)

(52) U.S. Cl. ..... 72/112; 72/116; 72/477; 72/481.1

(58) Field of Classification Search ..... 72/112, 72/115, 116, 117, 125, 317, 370.01, 370.06, 72/370.1, 393, 477, 478, 480, 481.1
See application file for complete search history.

(56) References Cited

U.S. PATENT DOCUMENTS 408,586 A * 8/1889 Coleman ..... 72/317
2,662,574 A * 12/1953 Franck ..... 72/317
3,086,575 A * 4/1963 Kowal ..... 72/317
4,144,735 A * 3/1979 Rothenberger ..... 72/393
4,223,545 A * 9/1980 Tucholski ..... 72/206
4,535,616 A * 8/1985 Eason ..... 72/116
4,733,551 A * 3/1988 Bryant et al. ..... 72/393

OTHER PUBLICATIONS

Wire & Cable Tools to Connect the World, Ripley Company Catalog, Wireless Tools, p. C44.

* cited by examiner

*Primary Examiner*—Ed Tolan
(74) *Attorney, Agent, or Firm*—DeLio & Peterson, LLC

(57) ABSTRACT

A flaring tool for flaring the outer conductors of two different sizes of coaxial cable includes a dome-shaped body and a reversible tool head. The tool head has first and second shafts and first and second flaring heads on opposite sides. Reversing the tool head exposes the shaft and flaring head for the corresponding size coaxial cable. The shafts match the inner diameter of the inner conductor of the coaxial cable to be flared. The flaring heads are shaped as half cones, which allow the outer conductor to be flared without deforming the insulation between the inner and outer conductors of the coaxial cable.

20 Claims, 3 Drawing Sheets

DUAL FLARING TOOL

BACKGROUND OF THE INVENTION

1. Field of the Invention

The present invention relates to flaring tools used to produce an outwardly flared edge on the outer conductor of a coaxial cable.

2. Description of Related Art

Coaxial cables include an inner conductor and a concentric outer conductor separated by an insulating dielectric material. The outer conductor of certain types of coaxial cables intended for high frequency applications is made of a solid, but thin, sheet of conductive material, such as copper or aluminum, which has the approximate shape of a thin-walled cylindrical pipe or tube. In order to permit the cable to be stored on a roll or routed around corners, the outer conductor may be annularly corrugated, which allows the cable to flex. In large diameter coaxial cables of this type, the inner conductor is hollow and tubular in shape.

In order to make a connection to a cable of the type described, a connector is placed over the end of the coaxial cable and the solid outer conductor is flared outward into contact with an inner surface of the connector. Flaring tools that are presently available to perform this function include a handle, an element that engages the center conductor, so that the tool may be rotated around the axis of the cable, and a conical flaring head that contacts the inner edge of the outer conductor and presses it outward to form the flare as the tool is rotated.

The element that engages the center conductor of larger diameter cables with hollow inner conductors is typically an outwardly extending shaft having an outside diameter corresponding to the inside diameter of the hollow inner conductor. The shaft is inserted into the hollow inner conductor in axial alignment with the cable and the tool is then pressed axially against the end of the cable. This brings the conical flaring head to the junction between the inner surface of the outer conductor and the outer surface of the insulating dielectric. The tool is then rotated around the axis of the cable and the conical flaring head presses the outer edge of the outer conductor outward to form the flare.

Prior art tools of the type described are typically suitable for only a single diameter cable. This requires the workman to carry one tool for each different diameter of cable that may need to be flared.

Another difficulty with prior art tools is that the conical flaring head produces an undesirable inward flare on the outer surface of the insulating dielectric material at the same time as the desired outward flare is produced on the outer conductor. This inward deformation of the dielectric insulator can produce signal distortions in high frequency cables.

Prior art flaring tools of the type described have typically used a relatively narrow and long handle, similar to a screwdriver handle. Such tools can be awkward to use and it is difficult for the workman to apply sufficient rotational torque to produce a flare on the largest diameter cables.

Bearing in mind the problems and deficiencies of the prior art, it is therefore an object of the present invention to provide a flaring tool that can flare more than one diameter of cable.

It is another object of the present invention to provide a flaring tool that does not distort the insulating dielectric material.

A further object of the invention is to provide a flaring tool that is compact, comfortable to use and allows the user to produce a high level of axially applied force while simultaneously producing a high rotational torque as required to flare large diameter coaxial cables.

Still other objects and advantages of the invention will in part be obvious and will in part be apparent from the specification.

SUMMARY OF THE INVENTION

The above and other objects, which will be apparent to those skilled in art, are achieved in the present invention, which is directed to a flaring tool for flaring the outer conductors of two different sizes of coaxial cable. The tool includes a body and a tool head that can be reversed to flare the outer conductor of the different sizes of coaxial cable.

The body has a front surface with a shaft opening formed therein. The shaft opening has a first diameter along a first length of the shaft opening and a second diameter along a second length of the shaft opening. The reversible tool head has opposed first and second surfaces that alternately make planar contact with the front surface of the body when the tool head is reversed.

The first surface includes an outwardly extending first shaft with a diameter corresponding to the first diameter of the shaft opening and a first flaring head that protrudes from the first surface. The first flaring head is offset from the first shaft a first distance that corresponds to a first type of coaxial cable to be flared. The second surface includes a second shaft extending in an opposite direction from the first shaft with a diameter corresponding to the second diameter of the shaft opening and a second flaring head that protrudes from the second surface. The second flaring head is offset from the second shaft a second distance that corresponds to the second type of coaxial cable to be flared.

The first flaring head is exposed for use when the second shaft is inserted into the shaft opening in the front surface of the body. The second flaring head is exposed for use when the tool head is reversed and the first shaft is inserted into the shaft opening in the front surface of the body.

The first and second flaring heads include conical surfaces. Although the conical surfaces may be fully conical, as in the prior art, it is preferred that they be only partially conical, being shaped as half cones. The half cone flaring head has a conical surface around one half of the flaring head and a flat surface around the other half so that the outer conductor of the coaxial cable can be flared without deforming the insulation inside the outer conductor.

The front surface of the body preferably includes a pair of flaring head openings that receive the first and second flaring heads so that the first and second surfaces can make planar contact with the front surface of the body. In the preferred design, the body and the tool head engage each other via an anti-rotation pin and corresponding opening to prevent rotation of the tool head relative to the body as the tool is rotated.

Also in the preferred design, the body is substantially dome-shaped to fit a user's palm during use. The dome-shape makes it easier for the user to apply an axial force needed to flare the outer conductor of the coaxial cable. The tool head and or the tool body may be provided with gripping surfaces to make it easier to rotate the tool during use. The gripping surface is preferably a series of spaced indentations around the perimeter of the tool head.

The body of the flaring tool is provided with first and second ball and spring catches alternately engaging the first and second shafts, respectively, as the tool head is reversed. The spring of the first catch urges the ball of the first catch partially into the first length of the shaft opening in the front surface of the body and into engagement with a groove in the first shaft when the first shaft is inserted into the shaft opening in the front surface of the body. The spring of the second catch urges the ball of the second catch partially into the second length of the shaft opening and into engagement with a groove in the second shaft when the tool head is reversed and the second shaft is inserted into the shaft opening in the body.

In the most highly preferred embodiment of the invention, the first and second shafts are formed as an integral single piece extending through the tool head. The first shaft extends perpendicularly outward from the first surface of the tool head and the second shaft extends perpendicularly outward from the second surface of the tool head.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–10 of the drawings in which like numerals refer to like features of the invention.

Figure 9:
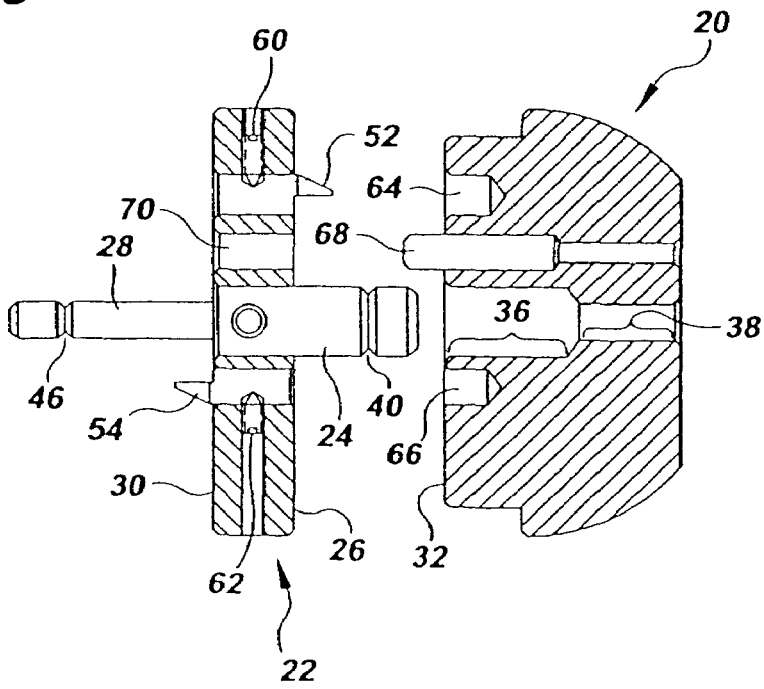
FIG. 9 is a cross sectional view of the flaring tool in FIG. 1 and substantially corresponds to the cross sectional view in FIG. 7 except that the tool head has been pulled outward from the body and reversed relative to FIG. 1.
Figure 10:
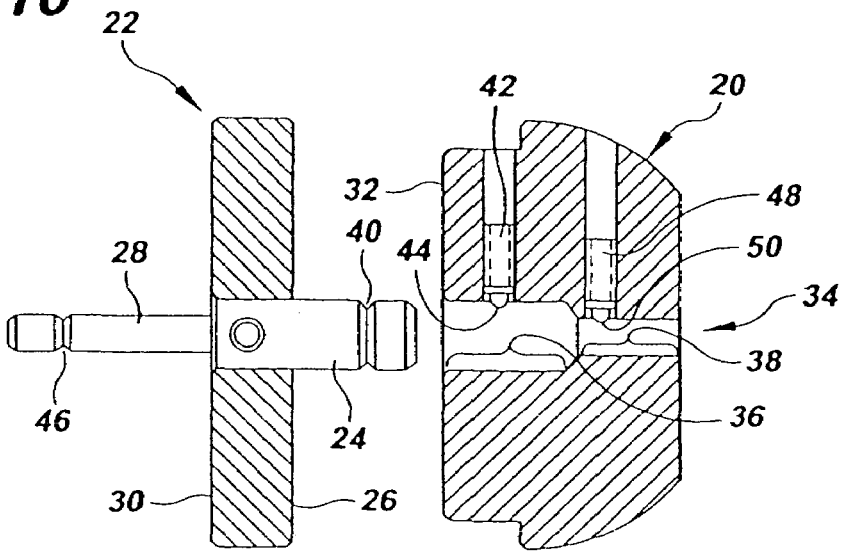
FIG. 10 is a cross sectional view of the flaring tool in FIG. 1 and substantially corresponds to the cross sectional view in FIG. 8 except that the tool head has been pulled outward from the body and reversed as in FIG. 9.

The flaring tool of the present invention includes a body 20 and a reversible tool head 22. FIGS. 1–8 show the assembled tool in the configuration used for flaring a large diameter cable. FIGS. 9 and 10 show the tool with the tool head 22 reversed and separated from the body 20, in position to be inserted into the body 20 as needed for flaring a smaller diameter cable.

The tool head 22 includes a first shaft 24 that extends perpendicularly outward from a first surface 26 of the tool head 22. A second shaft 28 extends perpendicularly outward from a second surface 30 of the tool head 22 (see FIGS. 9 and 10).

The body 20 of the tool has a front surface 32 that includes a shaft opening 34 having a first diameter along a first portion 36 of its length and a second smaller diameter along a second portion 38 of its length. As may be seen in FIGS. 9 and 10, the tool head 22 may be reversed to insert either the first shaft 24 or the second shaft 28 into the shaft opening 34 in the tool body.

When the first shaft 24 is inserted into the shaft opening 34, the first surface 26 makes planar contact with the front surface 32 of the body. FIGS. 9 and 10 show the tool head just prior to insertion of the first shaft 24 into the shaft opening. When the tool head is reversed, as seen in FIGS. 1–8, and the second shaft 28 is inserted into the shaft opening 34, the second surface 30 of the tool head makes planar contact with the front surface 32.

The first shaft 24 is slightly shorter than the second shaft 28. Accordingly, when the first shaft is inserted into the shaft opening, it only extends into the first portion 36 of the shaft opening 34. When the tool head is reversed and the second shaft 28 is inserted into the shaft opening, it extends through the first portion 36 of the shaft opening 34 and into the second portion 38, which has a slightly smaller diameter to match the diameter of the second shaft 28.

When the first shaft 24 is in the shaft opening 34, the second shaft extends outward from the front of the tool and is in position for use. Correspondingly, when the tool head is reversed, and the second shaft 28 is in the shaft opening 34, the first shaft extends outward from the front of the tool and is in position for use. The first and second shafts have diameters that correspond to the interior diameters of hollow inner conductors of coaxial cables.

By inserting the first shaft into an inner conductor of a coaxial cable, the entire tool can be rotated around the axis of the cable to outwardly flare the outer conductor as described below. By reversing the tool head, two different sizes of coaxial cable can be flared.

In order to hold the tool in the assembled condition, the tool is provided with first and second ball and spring catches (seen in FIGS. 8 and 10) that engage the first and second shafts respectively when they are inserted into the body. The first shaft 24 has a groove 40 that is engaged by the first ball and spring catch 42 when the first shaft is inserted into the body. The ball 44 of the first catch 42 extends into the first portion 36 of the shaft opening 34 and releasably holds the first shaft 24 by the groove 40.

Figure 8:
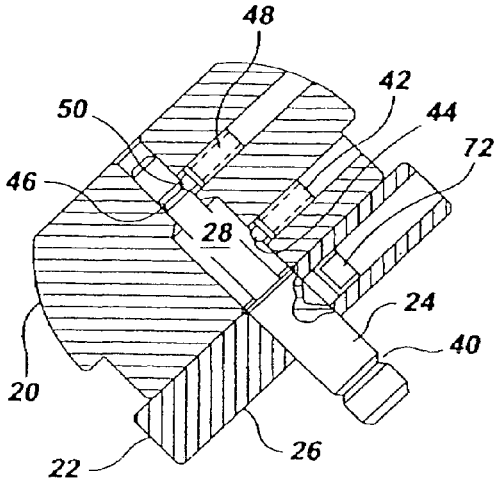
FIG. 8 is a cross sectional view of the flaring tool in FIG. 1 taken along the line 8—8 in FIG. 1.

When the tool head 22 is oriented as seen in FIG. 8 (first shaft extends outward), the second shaft 28 extends deeper into the shaft opening 34 and groove 46 on the second shaft is engaged by the second ball and spring catch 48. The second ball 50 of the second catch 48 extends into the second portion 38 of the shaft opening 34.

Figure 1:
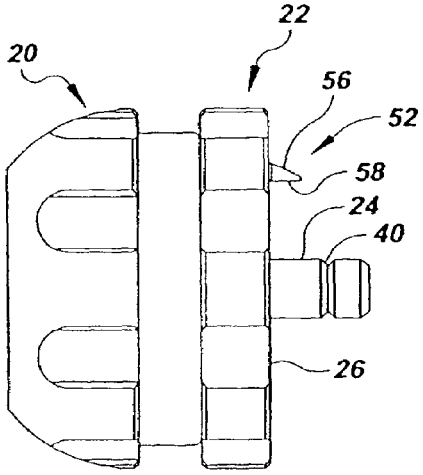
FIG. 1 is a left side elevational view of the flaring tool according to the present invention.
Figure 2:
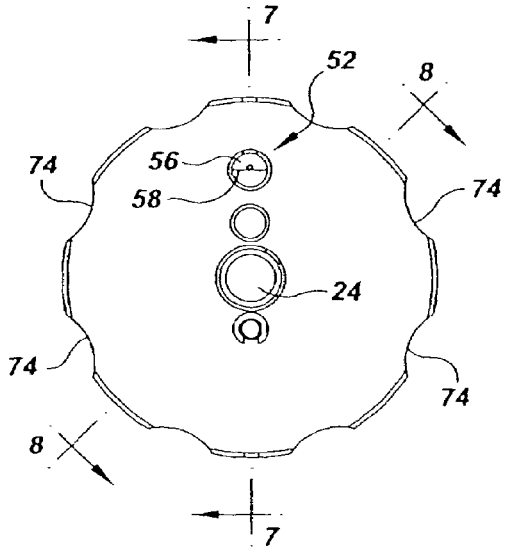
FIG. 2 is a front elevational view of the flaring tool in FIG. 1.
Figure 3:
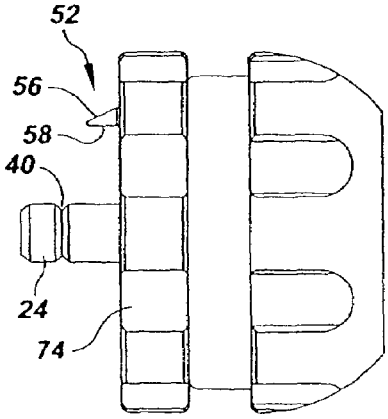
FIG. 3 is a right side elevational view of the flaring tool in FIG. 1.
Figure 4:
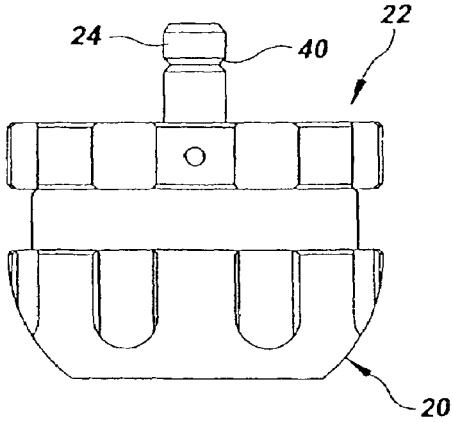
FIG. 4 is a bottom view of the flaring tool in FIG. 1.
Figure 5:
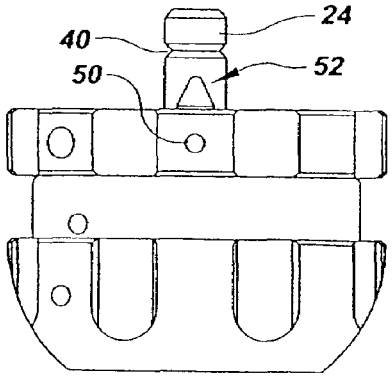
FIG. 5 is a top view of the flaring tool in FIG. 1.
Figure 6:
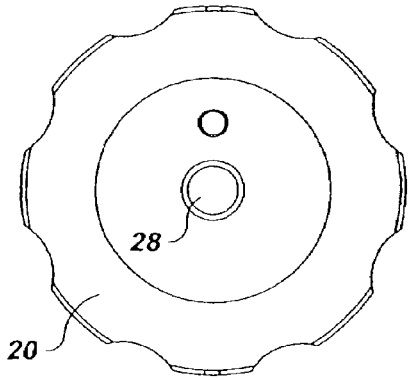
FIG. 6 is a back view of the flaring tool in FIG. 1.
Figure 7:
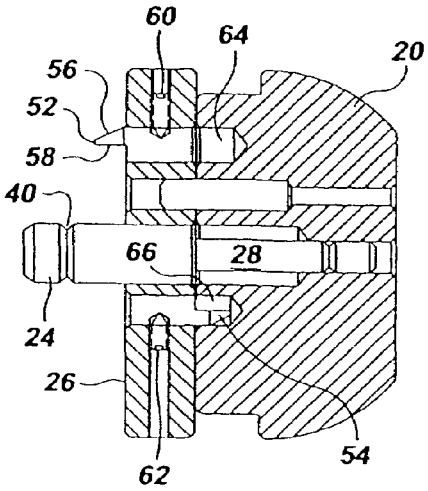
FIG. 7 is a cross sectional view of the flaring tool in FIG. 1 taken along the line 7—7 in FIG. 1.

In order to perform the flaring operation on the outer conductor, first and second flaring heads 52, 54 (see FIGS. 1 and 9) are provided. The flaring heads are shaped as half cones and are offset first and second distances from the axis of the first and second shafts 24, 28, respectively. Referring to FIG. 1 the first flaring head 52 has a conical surface 56 extending halfway around the head and a flat surface 58 on the opposite side. The half cone surface 56 is on the side of the flaring head 52 opposite the first shaft 24 and the flat surface 58 faces the first shaft 24. When the first shaft is inserted into the center conductor of a cable to be flared, the conical surface 56 presses the outer conductor of the cable outward. By rotating the tool relative to the cable, the outer conductor is flared around its entire perimeter, as required for the connector to be attached.

In prior art tools, the flaring head was a full cone and did not include the flat surface 58. The prior art full cone flaring head caused the insulation between the inner and outer conductors to be inwardly flared at the same time that the outer conductor was being outwardly flared. Changing the shape of the insulation between the inner and outer conductors was undesirable. The half cone of the present invention is positioned so that the flat surface 58 lies approximately at the interface between the outer conductor and the insulation when the first shaft 24 is in the inner conductor. When the tool is rotated to flare the outer conductor, the flat surface 58 rides just outside the insulation without deforming it.

The second flaring head 54 has the same half cone shape as the first flaring head 52 except it is slightly smaller and is located closer to the axis of the first and second shafts to correspond to the size of the smaller coaxial cable to be flared. As may be seen in FIGS. 7 and 9, the flaring heads 52, 54 are held in place with setscrews 60, 62. By removing the setscrews, the flaring heads can be removed and replaced if they become damaged or worn.

As can be seen in FIG. 9, the first and second flaring heads 52, 54 extend outward from the first and second surfaces 26, 30, respectively. In order that the first surface 26 can move into planar contact with the front surface 32, the front surface is provided with a first flaring head opening 64 that receives the first flaring head 52. A second flaring head opening 66 is provided in the front surface 32 to receive the second flaring head 54 when the tool head 22 is reversed (see FIG. 7).

In order to prevent the tool head 22 from rotating relative to the body 20, an anti-rotation pin 68 extends outward from the body and engages a corresponding anti-rotation opening 70 in the tool head 22 (see FIG. 9). The anti-rotation opening 70 extends completely through the tool head 22 from the first surface 26 to the second surface 30. This allows the anti-rotation pin 68 to enter the anti-rotation opening 70 from either side.

As can be seen in FIG. 9, the flaring head openings 64 and 66 are spaced different distances from the axis of the tool to correspond to the flaring heads 52, 54 and the diameter of the coaxial cable to be flared. In the preferred design shown, the first and second shafts 24, 28 are formed as an integral single piece that extends through the tool head 22. The piece forming the first and second shafts 24, 28 is held in place with a setscrew 72 (see FIG. 8). The first and second shafts, the first and second flaring heads and the anti rotation pin are all preferably formed of a wear resistant material, such as hardened steel.

In order to produce the flare on the outer conductor of the coaxial cable the user must apply an axial pressure to the tool as the tool is simultaneously rotated around the axis of the cable. Producing the necessary axial pressure is facilitated by the dome-shape of the tool body 22 (see FIGS. 1 and 3). The dome-shape of the body fits easily and comfortably into the palm of the user as axial pressure is applied. Applying the necessary torque to rotate the tool is made easier by spaced indentations 74 located around the perimeter of the tool head 22 which improve the tool user's grip on the tool. The spaced indentations on the tool head 22 may extend into the body (see FIGS. 1 and 3).

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A flaring tool comprising:

a body having a front surface with a shaft opening formed therein, the shaft opening having a first diameter along a first length of the shaft opening and a second diameter along a second length of the shaft opening; and a reversible tool head having opposed first and second surfaces, wherein:

the first surface includes an outwardly extending first shaft with a diameter corresponding to the first diameter of the shaft opening and a first flaring head protruding from the first surface, the first flaring head being offset from the first shaft a first distance; and the second surface includes a second shaft extending in an opposite direction from the first shaft with a diameter corresponding to the second diameter of the shaft opening and a second flaring head protruding from the second surface, the second flaring head being offset from the second shaft a second distance;

the first flaring head being exposed for use when the second shaft is inserted into the shaft opening in the front surface of the body and the second flaring head being exposed for use when the tool head is reversed and the first shaft is inserted into the shaft opening in the front surface of the body.

2. The flaring tool according to claim 1 wherein the first and second flaring heads include conical surfaces.

3. The flaring tool according to claim 1 wherein the first and second flaring heads are shaped as half cones.

4. The flaring tool according to claim 1 wherein the front surface of the body and the first and second surfaces of the tool head are all substantially planar whereby the first and second surfaces alternately lie in planar contact with the front surface as the tool head is reversed.

5. The flaring tool according to claim 1 wherein the front surface of the body includes a pair of flaring head openings for receiving the first and second flaring heads.

6. The flaring tool according to claim 1 wherein the body and the tool head engage each other to prevent rotation of the tool head relative to the body.

7. The flaring tool according to claim 6 wherein the body and the tool head engage each other via an anti-rotation pin and corresponding anti-rotation opening.

8. The flaring tool according to claim 1 wherein the front surface of the body includes an outwardly extending anti-rotation pin and the tool head includes an anti-rotation opening extending from the first surface to the second surface, the anti-rotation pin engaging the anti-rotation opening at the first surface when the second flaring head is exposed for use and the anti-rotation pin engaging an opposite end of the anti-rotation opening at the second surface when the tool head is reversed and the first flaring head is exposed for use.

9. The flaring tool according to claim 1 wherein the body is substantially dome-shaped to fit a user's palm during use.

10. The flaring tool according to claim 1 wherein the tool head is provided with a gripping surface.

11. The flaring tool according to claim 10 wherein the gripping surface comprises spaced indentations around a perimeter of the tool head.

12. The flaring tool according to claim 1 wherein the body further includes a first catch engaging the first shaft when the first shaft is inserted into the shaft opening in the front surface of the body.

13. The flaring tool according to claim 12 wherein the first catch comprises a first spring and ball catch, the spring of the first catch urging the ball of the first catch partially into the first length of the shaft opening in the front surface of the body, and the first shaft includes a groove engaged by the first catch when the first shaft is inserted into the shaft opening in the front surface of the body.

14. The flaring tool according to claim 12 wherein the body further includes a second catch engaging the second shaft when the second shaft is inserted into the shaft opening in the front surface of the body.

15. The flaring tool according to claim 12 wherein the second catch comprises a second spring and ball catch, the spring of the second catch urging the ball of the second catch partially into the second length of the shaft opening in the front surface of the body, and the second shaft includes a groove engaged by the second catch when the second shaft is inserted into the shaft opening in the front surface of the body.

16. The flaring tool according to claim 1 wherein the first and second flaring heads are removable.

17. The flaring tool according to claim 1 wherein the first and second shafts are formed as an integral single piece extending through the tool head, the first shaft extending perpendicularly outward from the first surface of the tool head and the second shaft extending perpendicularly outward from the second surface of the tool head.

18. The flaring tool according to claim 1 wherein the first and second shafts and the first and second flaring heads are formed of hardened steel.

19. A flaring tool comprising:

a body including a front surface, the body including:

an anti-rotation pin extending outward from the front surface;

a shaft opening formed in the front surface, the shaft opening having a first diameter along a first length of the shaft opening and a second diameter along a second length of the shaft opening;

a first flaring head opening formed in the front surface; and a second flaring head opening formed in the front surface;

a reversible tool head having opposed first and second surfaces, an anti-rotation opening extending from the first surface to the second surface and a gripping surface around a perimeter thereof, wherein:

the first surface includes an outwardly extending first shaft with a diameter corresponding to the first diameter of the shaft opening and a first flaring head protruding from the first surface, the first flaring head being offset from the first shaft a first distance; and the second surface includes a second shaft extending in an opposite direction from the first shaft with a diameter corresponding to the second diameter of the shaft opening and a second flaring head protruding from the second surface, the second flaring head being offset from the second shaft a second distance;

the first flaring head being exposed for use and the anti-rotation pin engaging the anti-rotation opening at the first surface when the second shaft is inserted into the shaft opening in the front surface of the body; and the second flaring head being exposed for use and the anti-rotation pin engaging the anti-rotation opening at the second surface when the tool head is reversed and the first shaft is inserted into the shaft opening in the front surface of the body.

20. A flaring tool comprising:

a dome-shaped body including a substantially planar front surface, the body including:

an anti-rotation pin extending outward from the front surface;

a shaft opening formed in the front surface, the shaft opening having a first diameter along a first length of the shaft opening and a second diameter along a second length of the shaft opening;

a first flaring head opening formed in the front surface;

a second flaring head opening formed in the front surface;

a first ball and spring catch, the spring of the first catch urging the ball into the first length of the shaft opening; and a second ball and spring catch, the spring of the second catch urging the ball into the second length of the shaft opening;

a reversible tool head having opposed first and second substantially planar surfaces, an anti-rotation opening extending from the first surface to the second surface and a gripping surface formed by spaced indentations around a perimeter thereof, wherein:

the first surface includes:

an outwardly extending first shaft having a perimetrical groove and a diameter corresponding to the first diameter of the shaft opening; and a first flaring head protruding from the first surface, the first flaring head being offset from the first shaft a first distance; and the second surface includes:

a second shaft extending in an opposite direction from the first shaft, the second shaft having a perimetrical groove and a diameter corresponding to the second diameter of the shaft opening; and a second flaring head protruding from the second surface, the second flaring head being offset from the second shaft a second distance;

the first flaring head being exposed for use, the second flaring head extending into the second flaring head opening in the front surface of the body and the anti-rotation pin engaging the anti-rotation opening at the first surface when the second shaft is inserted into the shaft opening in the front surface of the body; and the second flaring head being exposed for use, the first flaring head extending into the first flaring head opening in the front surface of the body and the anti-rotation pin engaging the anti-rotation opening at the second surface when the tool head is reversed and the first shaft is inserted into the shaft opening in the front surface of the body.

* * * * *